US005697314A

United States Patent [19]

Clausin

[11] Patent Number: 5,697,314

[45] Date of Patent: Dec. 16, 1997

[54] MAINSAIL REEFING SYSTEM

[75] Inventor: Pierre Clausin, Ville D'Avray, France

[73] Assignee: Proengin S.A., France

[21] Appl. No.: 721,098

[22] Filed: Sep. 27, 1996

[30] Foreign Application Priority Data

Sep. 29, 1995 [FR] France ..... 95 11589
Jul. 16, 1996 [FR] France ..... 96 08986

[51] Int. Cl.[6] ..... B63B 15/00
[52] U.S. Cl. ..... 114/106
[58] Field of Search ..... 114/39.1, 90, 89, 114/102, 103, 104, 105, 106, 107

[56] References Cited

U.S. PATENT DOCUMENTS 3,132,620 5/1964 Court .
4,724,787 2/1988 Chevalier et al. ..... 114/104

FOREIGN PATENT DOCUMENTS 2609273 7/1988 France .
2091190 7/1982 United Kingdom .

*Primary Examiner*—Stephen Avila
*Attorney, Agent, or Firm*—William A. Drucker

[57] ABSTRACT

The mainsail reefing system embodying the invention comprises a winding tube mounted rotatably parallel to the boom, and a device for rotatably driving the winding tube, mounted coaxially at the end of the latter situated on the side of the boom end secured to the mast, the mainsail being slidably mounted onto the mast by a bolt rope, integral with the sail, sliding in a recess extending over the entire length of the mast, the recess being made in a profiled member fixed parallel to and at a distance from the mast so as to form a slot between the profiled member and the mast, and so that the recess is situated vertically above the area for winding the bolt rope around the winding tube.

11 Claims, 5 Drawing Sheets

MAINSAIL REEFING SYSTEM

BACKGROUND OF THE INVENTION

1 - Field of the Invention

This invention relates to a mainsail reefing system mounted in or on the boom, for use on sailing boats.

2 - Description of the Prior Art

Generally, it is known that sail reefers mounted on the boom comprise a tubular member extending parallel to the boom and mounted rotatably so as to enable winding and unwinding of the mainsail, the latter being secured to the mast by means of a bolt rope which slides in the recess of a profile extending along the mast.

In certain cases, the boom is of tubular structure housing the winding tube, this structure being open in its upper part by way of a longitudinal slot to leave room for the sail to pass.

It has been observed that sail reefers of this type are not very satisfactory for the following different reasons.

On the one hand, the problem in driving the winding tube has not really been solved to date.

In fact, according to a first solution, the drive device is usually comprised of a drum that is coaxial and integral with the winding tube, around which the maneuvering cordage is wound, this drum, which is of a certain thickness, being installed at one end of the boom.

If the drum is mounted on the side of the end of the boom secured to the mast, the part of the sail situated near the boom, and therefore the corresponding part of the bolt rope, must be spaced apart from the mast by a distance corresponding to the thickness of the drum, thereby causing a deformation of the sail which increases when the latter is wound down and which inevitably causes folds at the end of the winding. Moreover, the bolt rope exerts a stress on the lips at the lower end of the recess, rendering the unwinding of the sail more difficult if not impossible if the bolt rope jams between the lips.

If the drum is installed on the side of the free end of the boom, so that the bolt rope can remain in the axis of the recess linked to the mast, three pulleys must be installed in order to bring the maneuvering cordage into the cockpit, i.e. a first pulley directing said cordage along the boom in the direction of the mast, a second pulley at the junction between the mast and the boom in order to direct this cordage downwardly along the mast, and a third pulley to direct the cordage towards the cockpit. It so happens that the friction generated by this set of three pulleys makes the winding and unwinding maneuvers difficult to perform.

Another solution consists in using a notched pulley that is thin by comparison with the drum and is also coaxial and integral with the winding tube, which is disposed at the level of the boom end fastened to the mast. In order to avoid the maneuvering cordage sliding on the notched pulley, use is made of two pulleys which bring the cordage back against the notched pulley, as well as two pulleys which direct the two strands of the maneuvering cordage towards another notched pulley which is operated by means of a handle. To this end, the cordage must also be kept taut, which is difficult to ensure notably due to the variations in the length of the cordage depending on whether it is dry or wet.

There ensues high friction stresses inherent to the notched pulleys and due to the large number of pulleys used, in addition to poor reliability in view of the risk of the cordage slipping which also means the cordage becomes quickly worn.

On the other hand, irrespective of the location of the drive means used, it can be observed that the recess maintaining the bolt rope is not situated vertically above the area for winding the bolt rope about the winding tube. The bolt rope thus exerts friction stresses at the level of the lips at the lower end of the recess and tends to jam between them if the bolt rope is subjected to a high degree of tension.

When the sail is subjected to the action of the wind, major friction stresses are also exerted between the bolt rope of the sail and the recess, which makes it difficult for the bolt rope to slide in the recess. The action of the wind on the sail tends to spread apart the lips of the recess. If this recess is made of an insufficiently rigid material, the bolt rope will tend to exit the recess by spreading the lips apart, and to jam between the latter.

When the sail is not in the axis of the recess, it also rubs against one lip of the recess, which further hinders or even prevents the bolt rope from sliding in the recess.

For these different reasons, the maneuvering of the sail, especially winding thereof which is usually performed in strong wind in order to reduce the area of sail subjected to the wind, requires a considerable effort, this maneuver being practically impossible if the boat is not substantially in the set of the wind.

Furthermore, winding devices of this type imply the use of sails with little belly in order to avoid deformation and the appearance of folds when shortening the sails. It so happens that the performances of such sails in running conditions are lower than those of conventional sails forming a larger belly. These performances are further deteriorated when the bolt rope of the sail is not parallel to the mast because of the drive device of the winding device.

OBJECT OF THE INVENTION

The main object of this invention is to remedy the preceding disadvantages, particularly to reduce the friction stresses generated during sail winding and unwinding maneuvers and to avoid deterioration of the performances of the sail due to the use of a sail reefing system.

SUMMARY OF THE INVENTION

Accordingly, in order to achieve these results, there is provided a mainsail reefing system comprising a winding tube mounted rotatably parallel to the boom and a means for rotatably driving the winding tube, mounted coaxially with the tube end situated on the end of the boom secured to the mast, the mainsail being slidably mounted on the mast by means of a bolt rope integral with the sail and sliding in a recess extending over the entire length of the mast.

According to the invention, this winding device is characterized in that the recess is made in a profiled member fixed parallel to and at a distance from the mast so as to form a slot between said profiled member and the mast, and so that the recess is situated vertically above the area for winding the bolt rope around the winding tube.

By way of these arrangements, the stresses exerted by the bolt rope on the recess during the winding maneuvers are considerably reduced. If the drive means of the winding device is constituted by a drum around which a maneuvering cordage is wound, one single pulley is needed to lead the maneuvering cordage towards the cockpit of the boat. Thus, the friction stresses opposing the maneuvering of the winding device are substantially reduced.

Furthermore, wind tunnel tests have shown that a slot effect is produced which improves the performances at running conditions of the mainsail thus spaced apart from the mast by the slot, while remaining unchanged close to the wind. In addition, the curves recorded during these tests show that the efficiency of the sail is less sensitive to variations in the direction of the apparent wind. It ensues that the output of the sail is less altered by uncontrolled movement of the boat or by a sail setting other than optimum.

According to one feature of the invention, the profiled member is mounted pivotally on the supports fastened to the mast and is secured to the boom so that the opening of the recess is maintained in the axis of the boom irrespective of the orientation of the latter.

Thus, the sail is always substantially centered between the two lips of the recess whatever the orientation of the boom. The stress caused by friction of the sail on the lips of the recess is thus practically eliminated, thereby rendering maneuvers even easier, especially the winding of the sail, independently of the direction of the wind in relation to the boat.

According to another feature of the invention, the device comprises two pulleys integral with the profiled member, placed at the top of the mast, the groove of the first pulley being placed at a tangent to the axis of rotation of the profiled member, while the second pulley is placed so as to bring the halyard vertically above the eyelet for fastening the halyard to the mainsail.

Again with a view to reducing the friction generated between the bolt rope and the mainsail-retaining recess and to eliminate the risk of the bolt rope jamming at the entrance to the recess, the profiled member is fitted with a bolt rope guide disposed at the entrance to the recess and comprising two rollers mounted rotatably about a common axis perpendicular to the plane of the sail, disposed on either side of the sail so as to guide the bolt rope into the axis of the recess opening.

Experience has proved that, even if the recess is maintained vertically above the area for winding the bolt rope onto the winding device, the bolt rope does not necessarily wind in the axis of the recess, thereby causing a pressure stress at the entrance to the recess capable of hindering and wearing, or even jamming the bolt rope between the lips of the recess. The utilisation of rollers enables this drawback to be completely eliminated.

BRIEF DESCRIPTION OF THE DRAWINGS

Further features and advantages of the sail reefing system according to the invention will be apparent from the embodiment described, by way of a non-limiting example, in reference to the corresponding accompanying drawings in which.

DESCRIPTION OF THE PREFERRED EMBODIMENTS

Figures 1, 2:
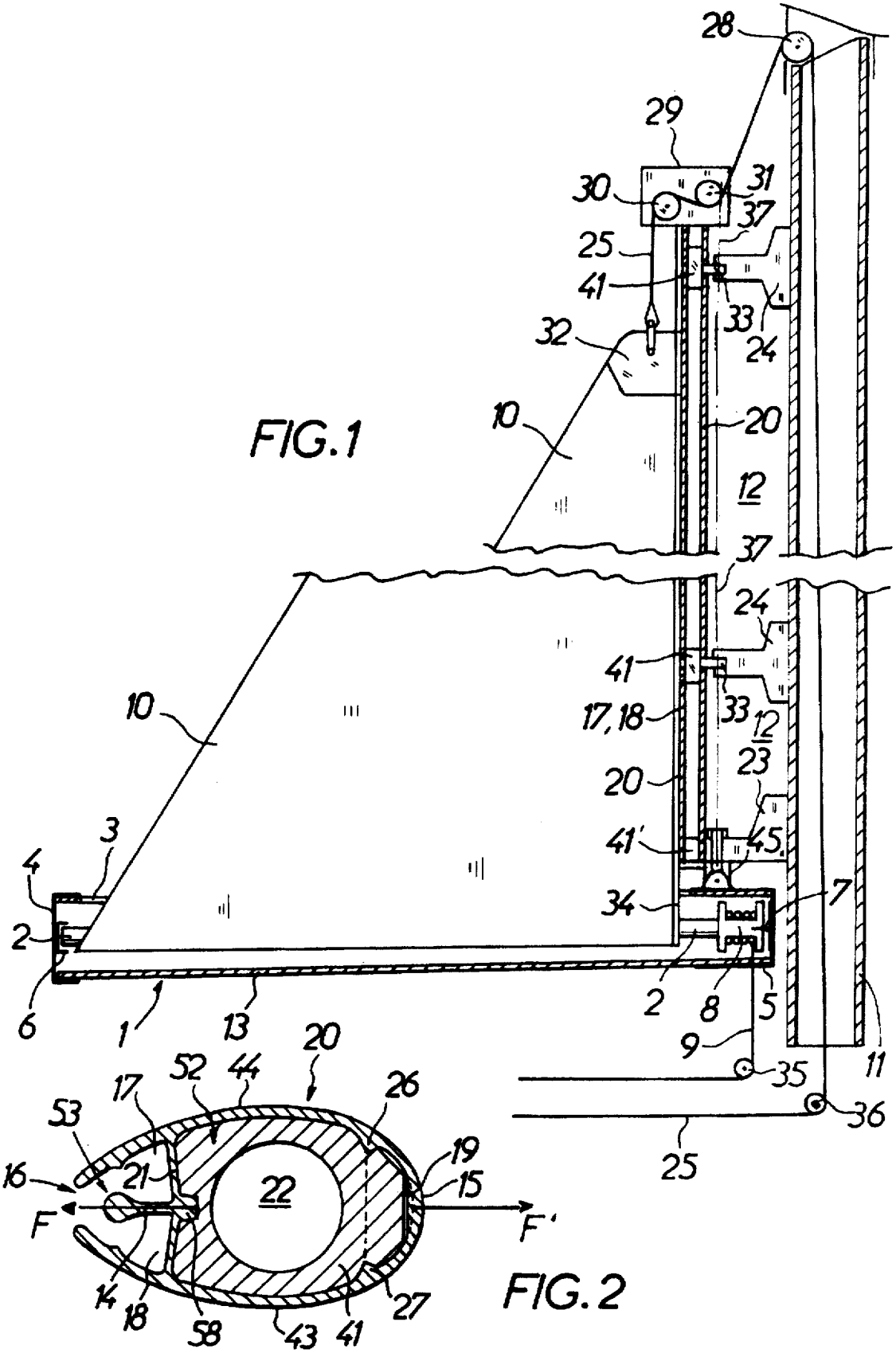
FIG. 1 is a schematic sectional drawing illustrating the principle of a mainsail reefing system embodying the invention, mounted inside a tubular-shaped boom.
FIG. 2 is cross-sectional view of a profiled member susceptible of being used in the winding device embodying the invention.

As represented in FIG. 1, the sail reefing system embodying the invention is mounted inside the boom 1 which is comprised of a tubular member 13 closed off at each of its ends by tubular covers 4, 5 fixed to the tubular member 13, e.g. by means of pop rivets. A slot 3 extending all along the upper part of the tubular member 13 lets the mainsail 10 pass. The tubular member 13 houses the sail reefing system proper comprising a winding tube 2 or mandrel substantially coaxial with the tubular member 13 about which the mainsail is wound, the winding tube 2 being mounted rotatably according to its longitudinal axis by means of two bearings 6, 7 disposed at both its ends. The tubular member 13 also comprises a coaxial drum 8 enabling it to be rotatably driven by way of a maneuvering cordage 9 of the winding device, this drum 8 being secured at the end of the winding tube 2 situated at the side of the mast 11. In this way, only one pulley 35 is needed to bring the maneuvering cordage 9 towards the rear of the boat where the cockpit is situated. The friction stresses opposing the mainsail winding or unwinding maneuvers are thus significantly limited.

In order for the bolt rope 34 of the mainsail 10 to be maintained parallel to the mast 11 and therefore for the mainsail 10 to be able to be wound without any folds around the winding tube 2, and despite the position of the drum 8 at the head of the boom, the bolt rope 34 is fed into the longitudinal recess 17, 18 of a profiled member 20 which is secured to the mast 11 by means of supporting parts 23, 34 so as to leave a slot 12 between the mast 11 and the profiled member 20. Thus, the profiled member 20 is maintained at a distance from the mast 11 so that the portion of the bolt rope 34 of the unfurled part of the sail is always vertically above the portion of the bolt rope wound around the winding tube 2.

Advantageously, the profiled member 20 is pivotally fixed to the supporting parts 23, 24 by means of linkage parts 33, while being subjected to the movements of the boom 1 in a plane perpendicular to the mast 11. In this way, the opening slot 16 of the recess 17, 18 in the profiled member 20 always remains oriented according to the longitudinal axis of the boom 1 irrespective of the angle formed between the boom 1 and the longitudinal axis of the boat. The friction stresses exerted between the recess and the sail are thus eliminated when the latter is not exactly in the axis of the recess slot.

Conventionally, the mainsail 10 is hoisted by means of a halyard 25 maneuvered from the cockpit, the halyard being brought to the head 32 of the mainsail by means of a first pulley 36 which guides the halyard towards the inside of the mast 11, and a second pulley 28 situated at the head of the mast which draws the halyard from inside the mast, leaving it vertically above the mounting eyelet provided in the head 32.

However, due to the presence of the slot 12, the halyard 25 is no longer vertically above the mounting eyelet of the head 32.

To remedy this drawback, use is made of a set of two pulleys 30, 31 e.g. mounted in a case 29, the groove of the first pulley 31 being placed at a tangent to the axis of rotation 37 of the profiled member 20 so as to direct the halyard 25 from the pulley 28 in a direction parallel to that of the boom 1, and the second pulley 30 directs the halyard from the pulley 31 in the direction of the mounting eyelet of the head 32.

In FIG. 2, the profiled member 20 has an outer shape of e.g. elliptical cross-section comprising two flattened lateral flanks 43, 44 ended on one side by a full edge (leading edge 15) and on the other side by a longitudinal slot 16 providing access to two internal longitudinal recesses 17, 18 each serving to receive the bolt rope 34 of the mainsail 10.

These two recess 17, 18 are delimited by a transversal wall 21 which divides the interior volume of the profiled member into two compartments 52, 53 of which one opens out towards the exterior via the slot 16, and by a radial wall 14 which extends from the central part of the wall 21 towards the slot 16, delimiting the two recess 17, 18.

The internal wall of the profiled member 20 comprises two inner ribbings 26, 27 which are symmetrical in relation to a longitudinal mid-plane of symmetry of the profiled member 20, in the vicinity of the leading edge 15.

Furthermore, a longitudinal ribbing 58 of trapezoid cross-section extends over the entire length of the central part of the transversal wall 21, protruding into the compartment 52. At the level of the leading edge 15, the wall of the profiled member 20 is reinforced so as to form a longitudinal flat surface 19 on the inside.

Figure 3:
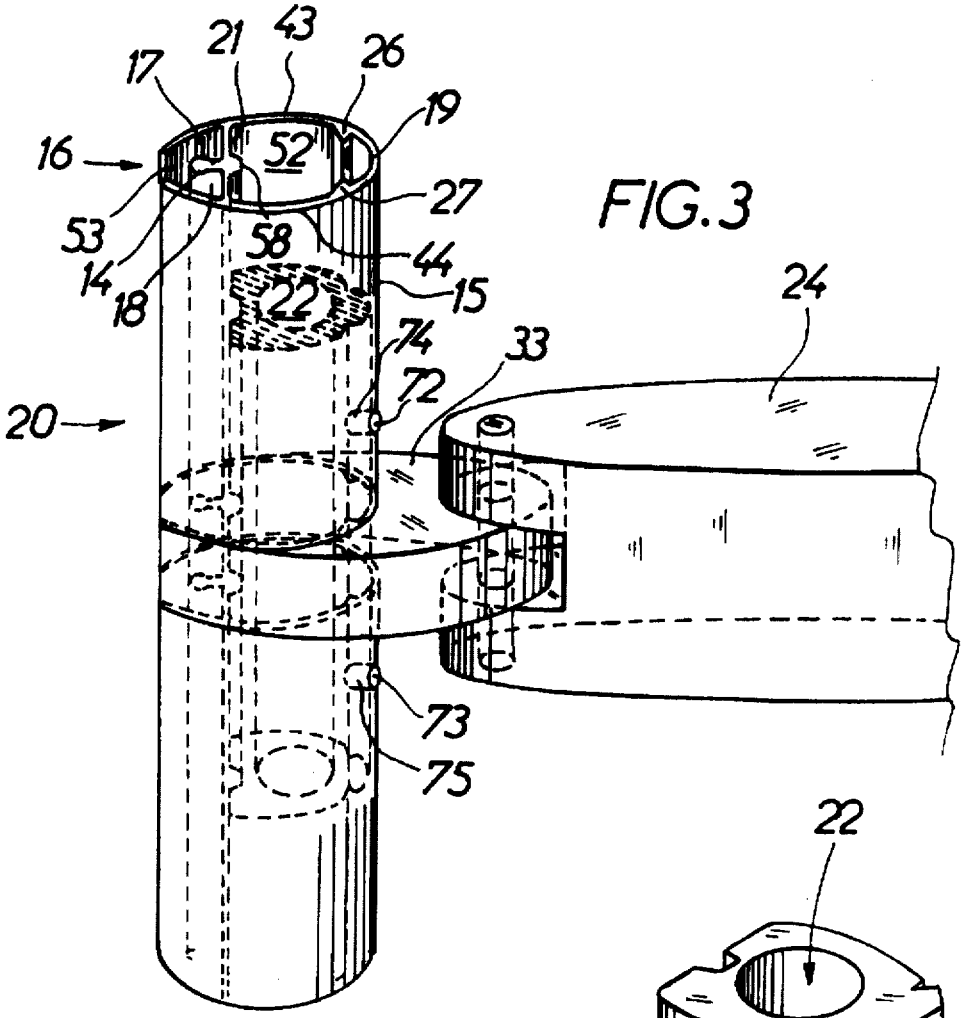
FIG. 3 is a schematic perspective view illustrating the principle of securing the profiled member to the mast.

As shown in FIG. 3, the profiled member 20 is in fact comprised of several sections assembled together by means of linkage parts 33 mounted pivotally on the supporting parts 23, 24.

The linkage parts 33 are of elliptical cross-section substantially identical to that of the profiled member 20, except for the fact that their leading edge includes an extension fitted with a longitudinal through bore in which is engaged an axis for fastening to the supporting part 24. Thus, the linkage part 33 can pivot in a plane perpendicular to the mast 11, and comprises a recess ensuring continuity between the respective recesses 17, 18 of two sections of the profiled member 20 which are connected thereto.

Figure 4:
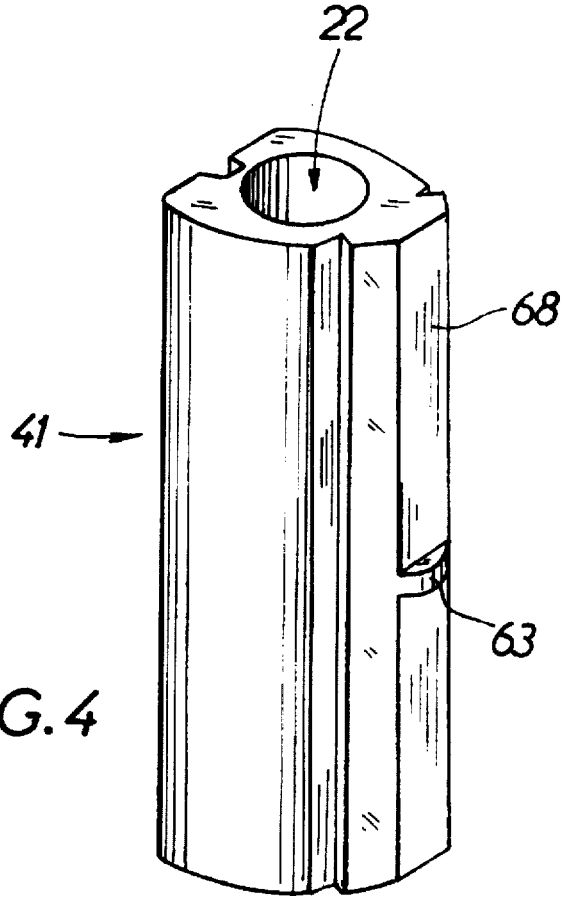
FIG. 4 is a perspective view of a member used for securing the profiled member to the mast.
Figure 5:
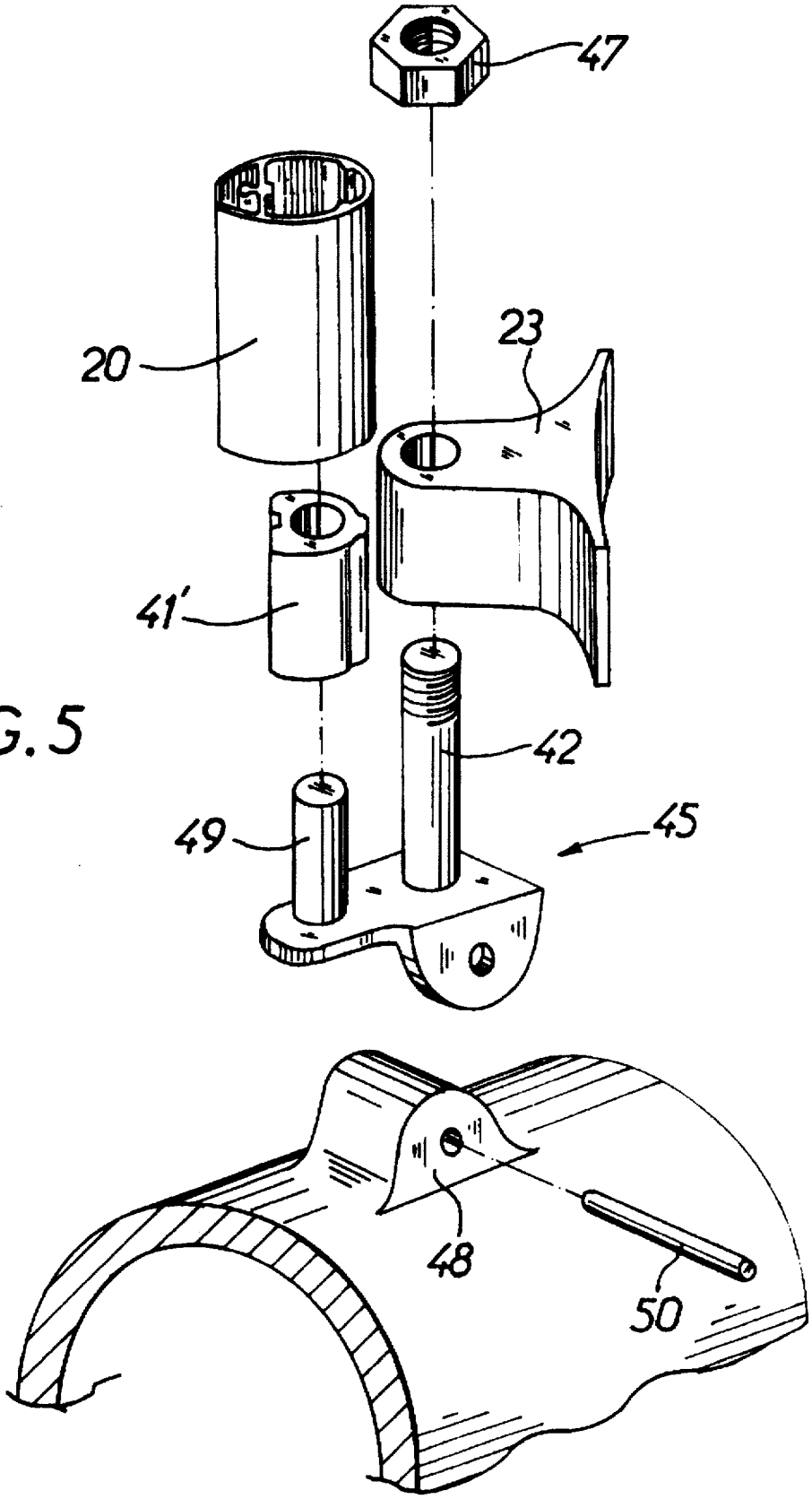
FIG. 5 is an exploded perspective view illustrating the principle of securing the profiled member to the boom and the boom to the mast.

Two sections of the profiled member 20 can be fastened to the linkage part 33 by means of a tubular-shaped fishplate 41 of which the outer shape corresponds, to within a clearance, to the shape of the compartment 52 and of which the inner shape 22 is e.g. cylindrical. In FIG. 4, the fishplate 41 is therefore of bulged shape 68 which corresponds to the inner shape of the leading edge 15.

A protrusion 63 is provided substantially in the central area of the flat surface 68 so as to axially position the fishplate 41 in the lower section of the profiled member 20.

During assembly of the sections of the profiled member 20, the fishplate 41 is firstly engaged in the compartment 52 of the lower section until the protrusion 63 fits into a slot (not represented in the FIGS.) provided to this end in the upper edge of the lower section, thus ensuring axial locking of the fishplate 41. In this position, less than half of the fishplate 41 is fitted into the lower section, the other part protruding axially.

The linkage part 33 is then fitted, followed by the upper section of the profiled member 20, onto the protruding part of the fishplate 41 until these elements meet end to end.

By way of tapped bores 72, 73 conveniently provided in the sections of the profiled member 20, screws 74, 75 are then screwed in to lock the fishplate into the sections of the profiled member 20.

In FIGS. 1 to 5, the boom 1 is suspended from the supporting part (gooseneck) 23 so as to be capable of pivoting both in a plane perpendicular to the mast and in the direction of the mast. To this end, the upper part of the cover 5 constituting the fixed end of the boom 1 comprises a hump 48 fitted with two flat sides parallel to the plane situated in the axis of the boom 1 and mast 11. A cap 45 comprising, on one side, two cheeks fitted on either side of the two sides parallel to the hump 48, is mounted pivotally by means of an axis 50 engaged in a bore successively crossing one of the two cheeks, the hump 48 of one of the two sides parallel to one another, then the second cheek of the cap 45. This cap comprises two axes 42, 49 extending perpendicularly to its other side in the direction of the top of the mast 11. The first axis 42 fits into a bore, parallel to the mast 11, in the supporting part 23 and comprises a threaded upper end intended to receive a nut 47.

Thus, the boom 1 is pivotally suspended from the supporting part 23, and the cap 45 follows the rotating motion of the boom 1 in the plane perpendicular to the mast 11.

The second axis 49, which is spaced apart from the first axis 42 in the direction of the free end of the boom 1, fits into the cylindrical cavity 22 of a fishplate 41', of shape identical to the fishplate 41, which in turn fits and fastens into the cavity 52 of one section of the profiled member 20 supporting the recess maintaining the bolt rope 34 of the mainsail 10. Thus, the profiled member 20 is controlled by the motion of the boom 1 in a plane perpendicular to the mast, so that the sail passage slot 16 is maintained in the axis of the boom.

Figure 6A:
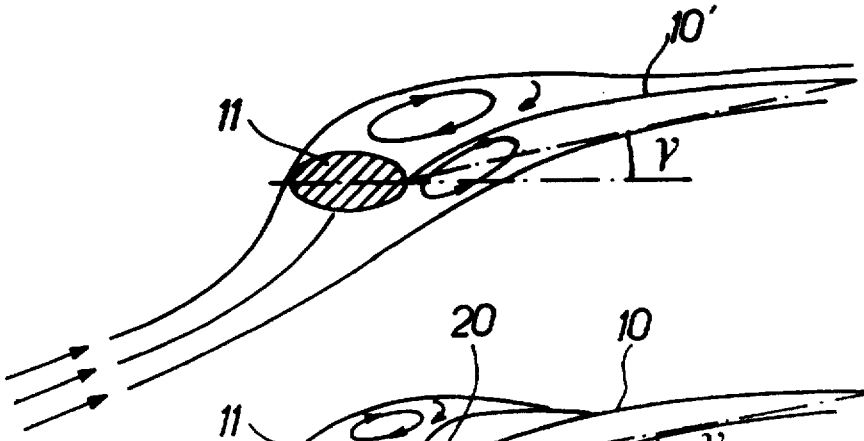
FIGS. 6A and 6B show a cross-sectional view of the airflow shapes about the mast and mainsail respectively without and with a slot between the mast and the sail.
Figure 6B:
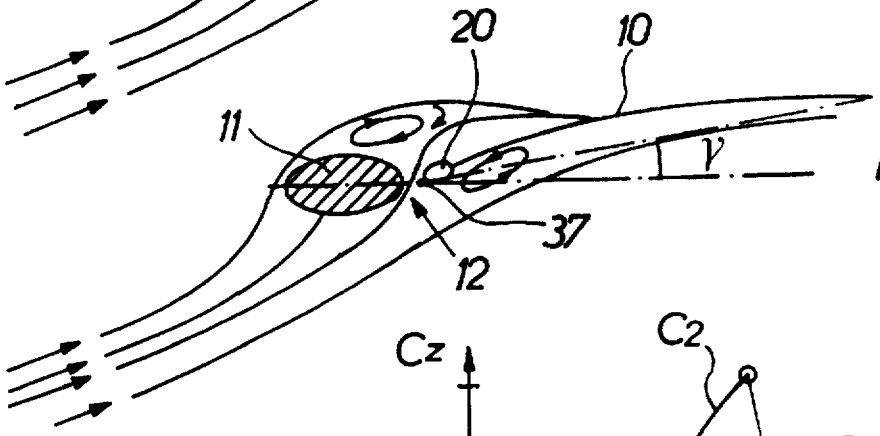

FIGS. 6A and 6B show the shape of the airstreams around the profiles of the mast 11 and mainsail 10, 10'. When the airstreams in these two FIGS. are compared, the turbulent zones responsible for drag and therefore for the poor performances of the mainsail (represented by elliptical-shaped airstreams) can be seen to be much smaller in the presence of the slot 12 (FIG. 6B) than in the absence of a slot (FIG. 6A). Furthermore, the airstreams run closer to the leeward side of the sail and closer to the mast in FIG. 6B than in FIG. 6A. Thus, by way of the slot 12, the mast behaves like a flap on the leading edge of an aircraft wing.

Figure 7:
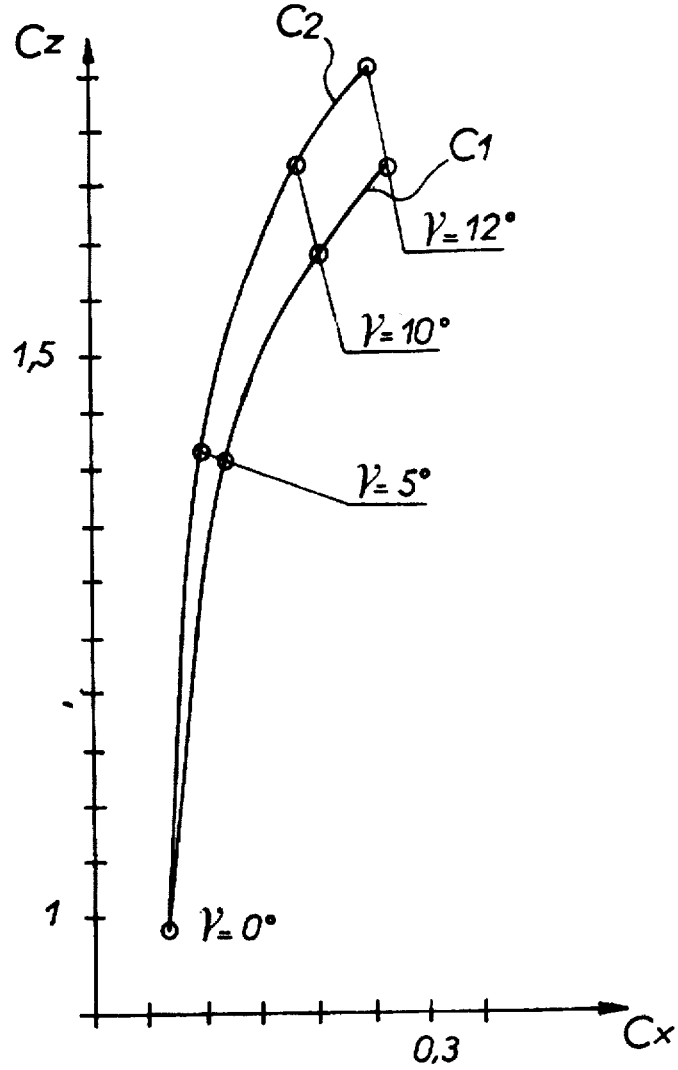
FIG. 7 represents the aerodynamic polar curves showing bearing capacity as a function of the drag of a mainsail, with and without a slot between the mast and the mainsail.

The efficiency gain of the sail obtained by means of the slot 12 is illustrated in FIG. 7 which shows the curves C1, C2 of the lift Cz as a function of the drag Cx, for angles between the axes of the boom 1 and the boat ranging between 0 and 12 degrees. These curves were obtained by using a sail and slot area equal to the area of the sail without a slot.

In very closed angles (close to the wind), the slot can be seen to have virtually no effect. Conversely, at conditions closer to running, on curve C2, the lift Cz is considerably enhanced in the presence of a slot and the drag Cx is slightly reduced in relation to curve C1.

Figure 8:
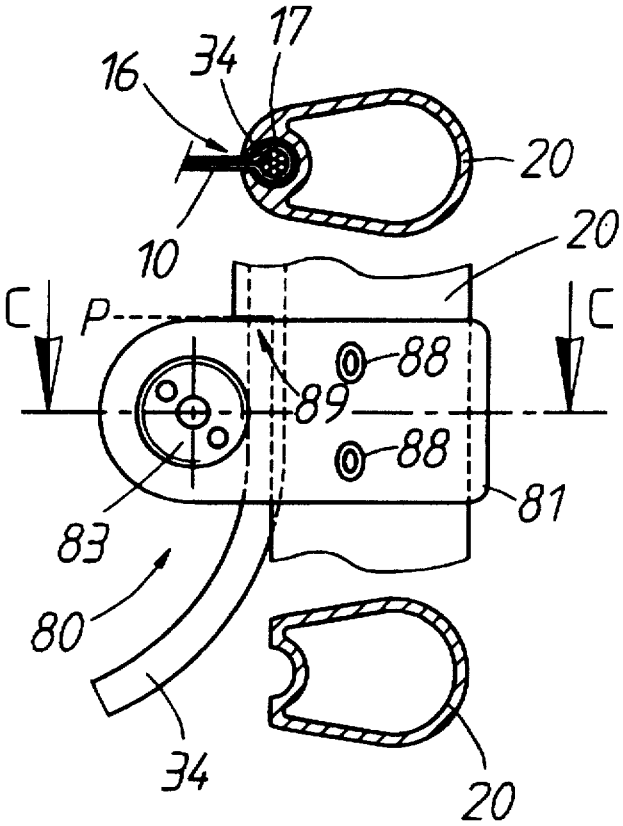
FIG. 8 represents an external view of the bolt rope guide mounted on the portion of the profiled member where the recess entrance is located, the sections of the profiled member being shown folded back above and below the bolt rope guide.
Figure 10:
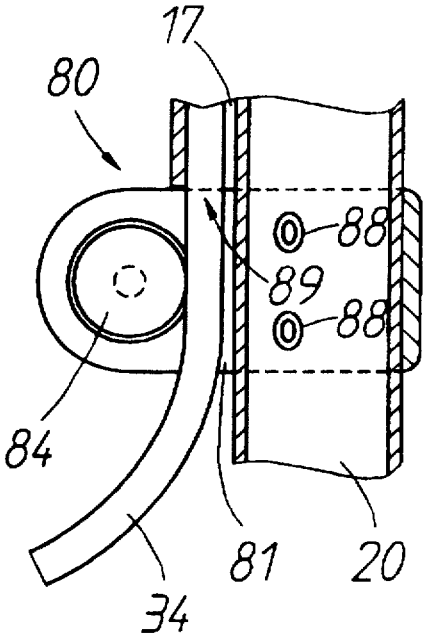
FIGS. 9 and 10 respectively represent an axial cross-section along the line CC and a longitudinal cross-section respectively of the bolt rope guide in FIG. 8.
Figure 9:
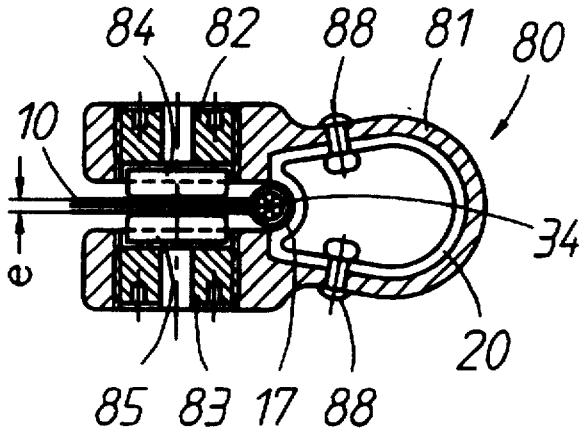
Figure 11:
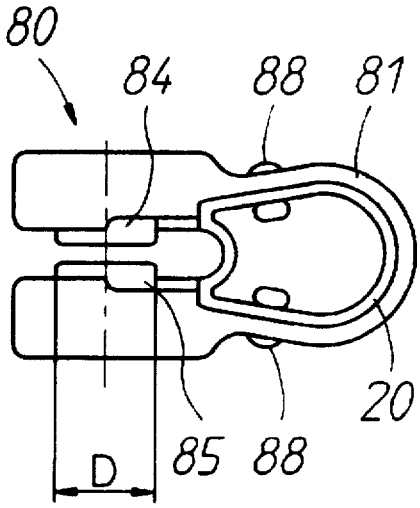
FIG. 11 is an axial cross-sectional view of the profiled member showing the underside of the bolt rope guide.

In FIGS. 8 to 11, the bolt rope guide 80 comprises a substantially U-shaped part which molds the outer shape of the profile 20 to which it is fixed, e.g. by means of four rivets 88. The bolt rope guide 80 comprises two coaxial bearings 82, 83 respectively supported by the branches of the U-shaped part 81, and two cylindrical rollers 84, 85 maintained rotating freely about a common axis, between the branches of the part 81, by the bearings 82, 83, the parallel and facing sides of the two rollers being separated by a space e enabling the sail 10 to circulate freely, the bolt rope 34 adjoining the sail resting on the cylindrical periphery of the rollers of diameter D, and rotatably driving the latter. In FIG. 8, the profile 20 recess lips can be seen to have been eliminated up to the position P of the entrance 89 to the recess 17, from which the bolt rope 34 must penetrate the recess, the rollers 84, 85 being fixed tangentially to the recess 17 so as to guide the bolt rope 34 in the axis of the recess 17.

The cylindrically-shaped bearings 82, 83 are e.g. fitted with an outer threading which cooperates with a tapping provided in the branches of the U-shaped part so as to enable accurate positioning of the bearings 82, 83 and, therefore, of the rollers 84, 85 so that the slot between the latter, in which the sail 10 passes, is situated in the axis of the slot 16 in the recess 17, and so that the space e between them is adjusted to suit the thickness of the sail 10 used.

Such a bolt rope guide enables all wear, hindrance or risk of jamming of the bolt rope to be eliminated.

Any other embodiment of the bolt rope guide is, of course, included in the invention, insofar as it uses two coaxial and rotary rollers, between which the sail passes, which are rotatably driven by contact with the bolt rope on their periphery.

I claim:

1. A mainsail reefing system for a sailboat comprising a mast, a boom and a mainsail supported by said mast and said boom, said boom having one end secured to the mast so as to enable the boom to pivot about a first pivotal axis parallel to and at a distance from the mast and about a second pivotal axis perpendicular to said first pivotal axis and to a longitudinal axis of said boom, said system comprising a winding tube mounted rotatably parallel to said boom longitudinal axis for winding and unwinding the mainsail, and drive means for rotatably driving the winding tube, mounted coaxially at an end of the latter situated on a side of said boom end secured to the mast, the mainsail being slidably mounted onto the mast by means of a bolt rope integral with the mainsail and sliding in a channel extending over the entire length of the mast, said channel having a longitudinal opening and a lower opening for inserting the bolt rope by an upper end thereof, said channel being made in a profiled member pivotally fixed parallel to and at a distance from the mast by means of support elements rigidly fixed to the mast and pivotally fixed to said profiled member so as to enable said profiled member to pivot about said first pivotal axis, an opened slot being formed between said profiled member and the mast and providing an aerodynamic slot effect, the profiled member being also fixed to and directly driven in rotation by the boom about said first pivotal axis, so that the longitudinal opening of the channel is maintained in a plane comprising the longitudinal axis of the boom and a longitudinal axis of the mast, and the lower opening of the channel is maintained vertically above an area for winding the bolt rope around the winding tube.

2. The reefing system as claimed in claim 1, comprising two pulleys integral with the profiled member, placed at a top of the mast, the first pulley being placed at a tangent to said first pivotal axis, while the second pulley is placed so as to bring a mainsail halyard vertically above an eyelet of the mainsail for fastening the mainsail halyard to the mainsail.

3. The reefing system as claimed in claim 1, wherein the drive means comprise a drum that is coaxial and integral with the winding tube, rotatably driven by means of a maneuvering cordage wound around the drum, the maneuvering cordage being directed towards a cockpit of the sailboat by means of a single pulley placed at a foot of the mast.

4. The sail reefing system as claimed in claim 1, wherein the profiled member is of tubular shape and is comprised of plural sections fixed to the mast by means of said support elements to which linkage parts are respectively pivotally fixed so as to pivot about said first pivotal axis, each of said linkage parts having a transversal cross-section comprising a part identical to that of the profiled member, extended by a part which cooperates with said first pivotal axis, two sections of said plural sections of the profiled member being assembled with one of said linkage parts by means of a fishplate passing through and locked in rotation into the linkage part and having two ends which are inserted and locked into the two sections of the profiled member placed above and below the linkage part.

5. The reefing system as claimed in claim 4, wherein the linkage part comprises a channel ensuring continuity between the respective channels of the two sections of the profiled member connected thereto.

6. The reefing system as claimed in claim 1, wherein said boom end secured to the mast is suspended from a supporting part fixed to a foot of the mast via an articulating part pivotally fixed to said supporting part about said first pivotal axis and mounted pivotally on the boom so as to enable the boom to pivot about said second pivotal axis, said articulating part being fixed to the profiled member by means of a fishplate fixed to the articulating part, and inserted and locked into the profiled member.

7. The reefing system as claimed in claim 1, wherein the profiled member has an elliptical cross-section and comprises two flattened lateral flanks ended on one side by a full edge and on one opposite side by said longitudinal opening providing access to two internal longitudinal channels, each serving to receive the bolt rope of the mainsail.

8. The reefing system as claimed in claim 1, wherein the lower opening of the channel of the profiled member is fitted with a guide means comprising two rollers mounted rotatably about a common axis parallel to said second pivotal axis, disposed on either side of the mainsail so as to guide the bolt rope into a longitudinal axis of the channel.

9. The reefing system as claimed in claim 8, wherein the rollers are cylindrical.

10. The reefing system as claimed in claim 8, wherein the rollers are mounted rotating freely by means of bearings screwed into a U-shaped part fixed to the profiled member.

11. The reefing system as claimed in claim 8, wherein the space between the rollers is adjustable, in order to be adapted to the thickness of the mainsail.

* * * * *